US006884323B2

(12) United States Patent
Beck et al.

(10) Patent No.: US 6,884,323 B2
(45) Date of Patent: Apr. 26, 2005

(54) VENTED MAIN ROLL FOR PRESS ASSEMBLY IN A PAPER MACHINE

(75) Inventors: David A. Beck, Appleton, WI (US); Thomas Gorshe, Neenah, WI (US)

(73) Assignee: Voith Paper Patent GmbH, Heidenheim (DE)

( * ) Notice: Subject to any disclaimer, the term of this patent is extended or adjusted under 35 U.S.C. 154(b) by 37 days.

(21) Appl. No.: 10/355,403

(22) Filed: Jan. 31, 2003

(65) Prior Publication Data

US 2004/0152574 A1 Aug. 5, 2004

(51) Int. Cl.[7] ..... D21F 3/10

(52) U.S. Cl. ..... 162/372; 162/367; 162/368; 162/374; 492/20; 100/121

(58) Field of Search ..... 162/367, 368, 162/372, 373, 204, 205, 217, 357; 100/110, 121, 155 R; 29/895.23, 895.3, 895.32; 492/20, 28–37

(56) References Cited

U.S. PATENT DOCUMENTS 483,340 A * 9/1892 Benham ..... 162/364
1,596,775 A * 8/1926 Stephansen ..... 162/368
1,742,991 A * 1/1930 Heys ..... 162/370
1,834,852 A * 12/1931 Kutter ..... 100/121
1,854,053 A * 4/1932 Millspaugh ..... 408/1 R
3,238,866 A * 3/1966 Ulf ..... 100/90
3,562,883 A * 2/1971 Kobayashi ..... 492/32
4,016,032 A * 4/1977 Kankaanpaa ..... 162/305
4,447,941 A * 5/1984 Schnell et al. ..... 492/36
5,135,614 A * 8/1992 Aula et al. ..... 162/217
6,029,570 A * 2/2000 Matuschczyk ..... 100/121
6,616,810 B1 * 9/2003 Brogyanyi et al. ..... 162/301

* cited by examiner

*Primary Examiner*—Steven P. Griffin
*Assistant Examiner*—Eric Hug
(74) *Attorney, Agent, or Firm*—Taylor & Aust, P.C.

(57) ABSTRACT

A roll for use in a paper machine includes a roll shell having an inner periphery. A roll cover is positioned around the roll shell and has an outer surface. The roll cover and/or the roll shell include at least one main flow channel positioned radially inward from the outer surface and radially outward from the inner periphery. The roll cover includes at least one secondary flow channel in communication with each of the outer surface and at least one main flow channel.

31 Claims, 5 Drawing Sheets

VENTED MAIN ROLL FOR PRESS ASSEMBLY IN A PAPER MACHINE

BACKGROUND OF THE INVENTION

1. Field of the Invention

The present invention relates to paper machines, and, more particularly, to rolls used in press assemblies of paper machines.

2. Description of the Related Art

The application of suction rolls, especially press suction rolls in press sections of paper machines limits the maximum line force of presses, because the shell is weakened by the drilled holes through the shell. A great number of holes is needed to get a great open area, which gives a good, safe and sufficient dewatering behavior.

During development of an air press process, it has been found that once air passes through the sheet, there are inadequate flow channels to allow the air to pass out of the system. Grooves or blind drilled holes in the roll impede the flow of air out of the system. The reason for this is simple. The exit path for the air requires that the air pass into the grooves and then flows within the grooves until it exits under the cap-main roll nip. Because of the geometry of the grooves and because of the need to prevent breakage of the land areas between the grooves, there can never be enough capacity in a grooved roll, no matter what size groove is used.

Due to the quantity of air needed for dewatering, it has been found that air velocity in the grooves may become supersonic in order to handle all the air needed for the process. The need for supersonic air flow really means that the grooves cannot handle the flow, and that they will present a tremendous backpressure to impede dewatering.

In addition to the need for a low impedance path for airflow, there are also other imposed constraints. One concern has to do with the huge mechanical load impressed on the main roll. In a known air press, the pressure arc can be 1 meter long in the machine direction. This arc length times the width of the machine gives the total pressurized surface area in the pressure chamber. This surface area multiplied by the air pressure equals the total load impressed on the main roll by the air pressure. This air load can be huge, and it has been found that substantial rolls will be needed to support the load. This puts severe limits on the roll construction since rotating shell constructions similar to suction rolls cannot be easily used.

Another constraint for an air press relates to the support of the fabrics as they pass through the pressing process. It has been found that the main roll needs to be reasonably flat. If there are wide valleys or groove in the main roll, the dewatering fabrics will dip into these valleys, and this can cause a leak in the main roll to cap roll nip seal. Air can escape under the cap roll in channels along the grooves if the grooves are too wide.

Yet another constraint is the need for the uniform flow of air through the sheet. As groove spacing increases, airflow becomes less uniform. As uniformity decreases, more air is needed to dewater the sheet.

SUMMARY OF THE INVENTION

The present invention provides a vented roll for use in a paper machine which includes a roll shell and a roll cover. One or more main flow channels are formed in the roll between the inner periphery of the roll shell and the outer surface of the roll cover. One or more secondary flow channels, preferably in the form of rings or helical shaped slots, extend radially inward from the outer surface of the roll cover and communicate with one or more of the main flow channels. The main flow channels may be in the form of tubes or holes.

The invention comprises, in form thereof, a roll for use in a paper machine, including a roll shell having an inner periphery. A roll cover is positioned around the roll shell and has an outer surface. The roll cover and/or the roll shell include at least one main flow channel positioned radially inward from the outer surface and radially outward from the inner periphery. The roll cover includes at least one secondary flow channel in communication with each of the outer surface and at least one main flow channel.

The invention comprises, in another form thereof, a method of manufacturing a roll for use in a paper machine, including the steps of: providing a roll shell; covering the roll shell with a roll cover; forming at least one main flow channel radially inward from an outer surface of the roll cover and radially outward from an inner periphery of the roll shell; and machining at least one secondary flow channel in the roll cover which is in communication with each of the outer surface and at least one main flow channel.

The invention comprises, in yet another form thereof, a method of operating a roll in a paper machine, including the steps of: providing a roll shell having opposite ends and an inner periphery; providing a roll cover around the roll shell, the roll cover having an outer surface; providing at least one main flow channel radially inward from the outer surface and radially outward from the inner periphery, each main flow channel having opposite ends terminating at the respective roll shell ends; providing at least one secondary flow channel in the roll cover, each secondary flow channel being in communication with each of the outer surface and at least one main flow channel; and at least intermittently sealing the ends of the main flow channel during rotation of the roll.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
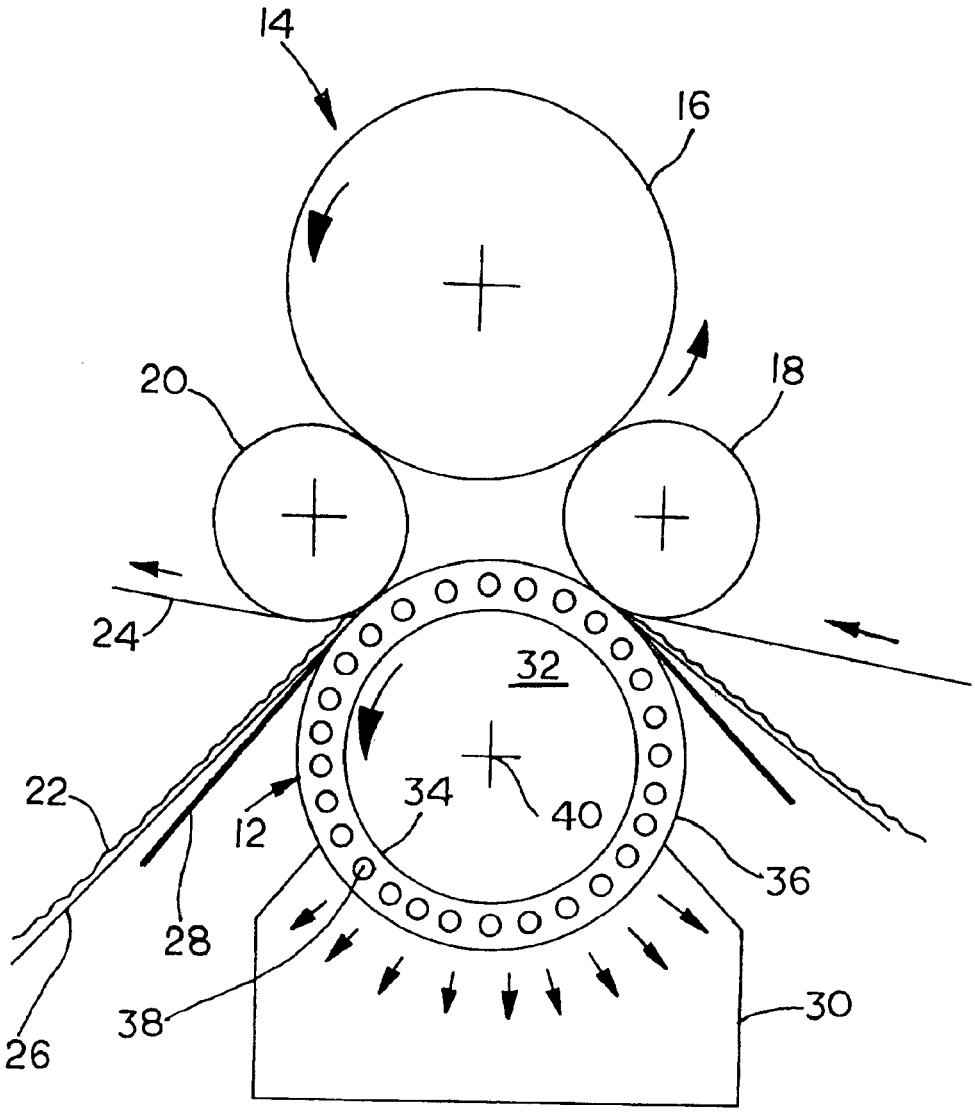
FIG. 1 illustrates an embodiment of an air press assembly including a vented roll configured according to the present invention.

Referring now to the drawings, and more particularly to FIG. 1, there is shown an embodiment of a paper machine 10 utilizing a roll 12 of the present invention. The term "paper machine" as used herein, is intended in its broad sense to mean a machine for the production of a fiber web, such as a paper web, tissue web or cardboard web. Roll 12 is part of an air press assembly 14 which also includes a main roll 16 and cap rolls 18, 20. Fiber web 22, which in the embodiment shown is a paper web, travels through pressure chamber $P_c$ defined between main roll 16, cap rolls 18, 20 and roll 12 of the present invention. More particularly, a membrane 24 is exposed directly to the pressure within pressure chamber $P_c$. Fiber web 22 is sandwiched between membrane 24 and an anti-rewet 26 (or optionally felt). Anti-rewet 26 may be directly carried by the outer periphery of roll 12. Alternatively, an optional air diffusion member in the form of an air diffusion fabric 28 may be directly carried by roll 12 and interposed between roll 12 and anti-rewet 26. Air diffusion member 28 may also be in the form of an air diffusion sleeve wrapped around roll 12, rather than an air diffusion fabric as shown.

Roll 12 generally functions to partially define pressure chamber $P_c$ and remove water expressed from fiber web 22. Water removed from fiber web 22 using roll 12 is discharged to a save-all pan 30 for removal or further processing.

Roll 12 generally includes a hollow interior 32 with an inner periphery 34 and an outer surface 36. A plurality of tubes 38 positioned between inner periphery 34 and outer surface 36 extend generally parallel to a longitudinal axis 40 the entire length of roll 12. Water removed from fiber web 22 is drawn into tubes 38 and discharged from one or both ends of tubes 38 into save-all pan 30.

Figure 2:
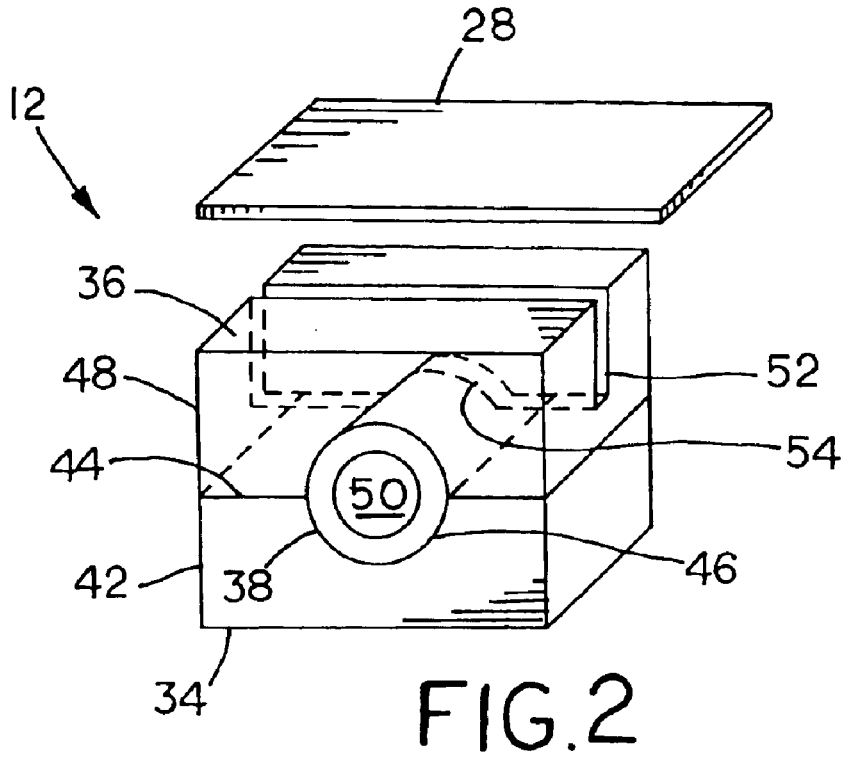
FIG. 2 is a fragmentary, perspective view of a portion of the vented roll shown in FIG. 1.

More particularly, referring to FIG. 2, there is shown a more detailed view of a portion of roll 12 illustrated in FIG. 1. Roll 12 includes a roll shell 42 with inner periphery 34 and an outer periphery 44. Outer periphery 44 is formed with a plurality of longitudinally extending, parallel grooves 46, one of which is shown in FIG. 2. Each groove 46 has a radius which generally corresponds to the outside diameter of a tube 38. Grooves 46 may be formed in outer periphery 44 of roll shell 42 using any suitable manufacturing technique.

In the embodiment shown, roll shell 42 typically has a thickness of 2–6 inches, usually approximately 4–5 inches. Roll shell 42 may be formed from a material providing suitable physical properties, such as steel or stainless steel.

Roll 12 also includes a roll cover 48 which extends around the outer periphery 44 of roll shell 42 for the entire length of roll 12. Roll cover 48 is in close and continuous intimate physical contact with outer periphery 44 and tubes 38. That is, roll cover 48 is formed over outer periphery 44 and tubes 38 so as to in essence mold to the shape defined by outer periphery 44 and tubes 38.

Each tube 38 defines a main flow channel 50 at the interior thereof. Tube 38 generally is sized so that main flow channel 50 provides a desired flow rate based upon expected operating pressure conditions, such as ambient pressure, a vacuum pressure or a positive pressure. For example, tube 38 may have an outside diameter of approximately 34 inch and a tube wall thickness sufficient to withstand an expected pressure within main flow channel 50 and expected nip loads. Each tube 38 may have a varying inside diameter and/or a different outside diameter and wall thickness, depending upon the particular application. Tubes 38 may be formed from a suitable material, such as epoxy, fiberglass, carbon fiber, rubber or stainless steel.

Roll cover 48 includes a plurality of longitudinally spaced secondary flow channels 52, one of which is shown in FIG. 2. In the embodiment shown, each secondary flow channel 52 is in the form of a ring-shaped slot extending around and into outer surface 36. The ring-shaped slots are sized and longitudinally spaced apart from each other depending upon an anticipated water flow rate, support for anticipated loads, and fabric bridging. Secondary flow channels 52 extend radially inward from outer surface 36 of roll cover 48, and are in communication with both outer surface 36 and at least one main flow channel 50. When a plurality of tubes are concentrically positioned about longitudinal axis 40 as shown in FIG. 1, secondary flow channel 52 intersects and is in communication with each main flow channel 50 of corresponding tubes 38 as shown by phantom line 54 in FIG. 2).

In the embodiment shown, secondary flow channels 52 are generally ring shaped as described above. However, it is also possible for secondary flow channels 52 to be configured as a continuous slot which is formed in a helical manner around roll cover 48. To this end, it will be appreciated that the machine tool for cutting the helical slot into roll cover 48 may be advanced in a longitudinal direction at a predetermined longitudinal feed rate while the roll rotates at another predetermined rate, thereby setting the helical path around roll cover 48.

Roll cover 48 has a minimum thickness so as to overly the portion of tubes 38 closest to outer surface 36. Roll cover 48 may be formed from any suitable material, such as plastic, fiberglass, urethane, epoxy, rubber, a polymeric material, or a composite of a plurality of these materials.

Air diffusion fabric 28 wraps a portion of roll 12 as shown in FIG. 1. Air diffusion fabric 28 spans across secondary flow channels 52 formed in outer surface 36, and thus provides a flat surface for anti-rewet 26 and fiber web 22 to be carried on during operation. This ensures that neither anti-rewet 26 nor fiber web 22 sags into the slot shaped secondary flow channel 52 at outer surface 36. Air diffusion fabric 28 is formed from a material which allows air and liquid drawn from fiber web 22 to travel in transverse directions along outer surface 36 to ensure adequate flow of the air and liquid into secondary flow channels 52 and main flow channels 50. Air diffusion fabric 28 is thus a porous fabric with a thickness and porosity of the fabric varying depending upon the particular application.

During the manufacture of roll 12, grooves 46 are formed in the outer periphery 44 of roll shell 42 extending the entire length of roll shell 42. Grooves 46 extend generally parallel with the longitudinal axis of roll 12, and are generally equidistantly spaced around outer periphery 44. Tubes 38 are then positioned within corresponding grooves 46 and held in place using a suitable adhesive, bonding technique, etc. Roll cover 48 is then formed over outer periphery 44 so as to be in close and continuous intimate physical contact with the portion of tubes 38 extending radially outward from outer periphery 44 as well as the land areas between adjacent tubes 38. A plurality of secondary flow channels 52 or a continuous secondary flow channel 52 is then formed in roll cover 48 extending from outer surface 36. Secondary flow channels 52 extend radially inward from outer surface 36 a distance which is sufficient to ensure intersection and thus fluid communication with main flow channels 50. Air diffusion fabric 28 is positioned radially outward from outer surface 36.

During operation, and referring to FIGS. 1 and 2, conjunctively, pressure within pressure chamber $P_c$ exerts a pressure against membrane 24, which in turn exerts a pressing force against fiber web 22. The water pressed from fiber web 22 flows through anti-rewet 26, optional diffusion fabric 28 and into secondary flow channels 52 carried by air flowing through membrane 24. The water flows through secondary flow channels 52 into main flow channels 50, and then in a generally longitudinal direction through main flow channels 50 to one or both ends of tube 38. A suitable sealing arrangement is provided at the ends of tubes 38 to selectively seal a portion or subset of the total number of tubes 38 during rotation of roll 12. The water and air mixture may flow from the ends of tubes 38 into save-all pan 30 either under the pressing force and/or air flow applied by pressure chamber $P_c$, a vacuum source applied to the selectively sealed tube ends or a positive pressure source applied to the tubes. Water may also be evacuated from the tubes through the roll surface by applying air pressure to the ends of the tubes.

Figure 3:
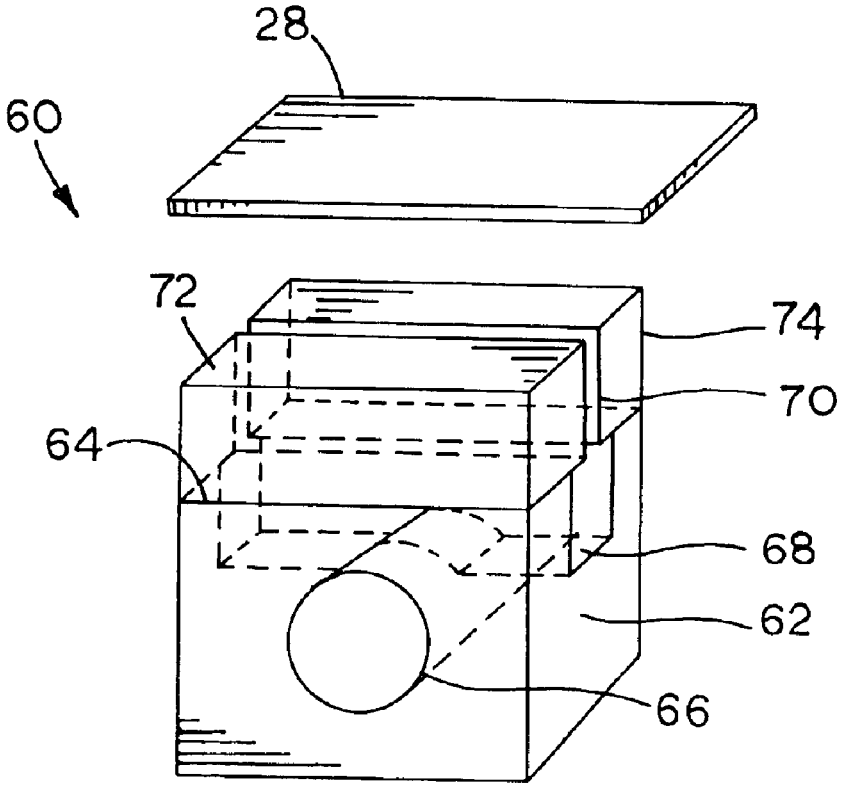
FIG. 3 is a fragmentary, perspective view of another embodiment of a vented roll of the present invention which may be used in a paper machine.

FIG. 3 illustrates another embodiment of a roll 60 of the present invention, which may be utilized within a paper machine. As is apparent, roll 60 is similar in many respects to roll 12 shown in detail in FIG. 2. Roll 60 differs from roll 12 in two primary respects. First, roll shell 62 is not formed with a plurality of grooves at the outer periphery 64 thereof. Rather, a plurality of main flow channels 66 in the form of cylindrical holes are gun drilled in an angularly spaced manner around roll shell 62 at a predetermined distance from outer periphery 64. Each main flow channel 66, one of which is shown in FIG. 3, extends the entire length of roll shell 62. The diameter of each main flow channel 66 varies dependent upon expected flow rates and pressures during operation.

Another distinction of roll 60 relative to roll 12 is that roll 60 includes a plurality of secondary flow channels of varying width. To wit, a plurality of wider secondary flow channels 68 extend radially inward from outer periphery 64 of roll shell 62 to intersect and communicate with corresponding main flow channels 66. Secondary flow channels 70 are narrower and extend radially inward from outer surface 72 of roll cover 74 to communicate with corresponding secondary flow channels 68 in roll shell 62. This allows a smaller width gap at outer surface 72 of roll cover 74 to inhibit sagging of air diffusion fabric 28 or fiber web 22, while at the same time allowing an increased flow rate into main flow channels 66 since the restricted portion of the flow path through secondary flow channels 70 and 68 is minimized.

During manufacture, main flow channels 66 are rifle drilled in roll shell 62 generally parallel to the longitudinal axis of roll 60. Main flow channels 66 are generally equidistantly spaced around roll shell 62 at a predetermined distance from outer periphery 64. The wider secondary flow channel 68 is then cut into roll shell 62 in a radially inward direction from outer periphery 64. Wider secondary flow channels 68 extend into roll shell 62 a sufficient distance to ensure intersection and communication with main flow channels 66. Roll cover 74 is then formed around outer periphery 64 of roll shell 62. A narrower secondary flow channel 70 then is formed into roll cover 74 extending radially inward from outer surface 72 to be in communication with wider secondary flow channel 68 in roll shell 62. An air diffusion fabric 28 or an air diffusion sleeve is then wrapped around at least a portion of the periphery of roll 60. Operation of roll 60 is similar to that described above with reference to roll 12, and will not be described in further detail.

FIGS. 4–7 illustrate further embodiments of rolls 80, 82, 84 and 86. Rolls 80, 82 and 84 each include a roll shell 88 formed with a plurality of grooves 90 receiving respective tubes 92. Each roll 80, 82 and 84 also has a two-layer roll cover 94 with a radially inner portion formed from one material and a radially outer portion beginning closely adjacent to tubes 92 formed from another material (on either side of the phantom line).

Roll covers 94 of rolls 80, 82 and 84 each include a plurality of longitudinally spaced secondary flow channels 96 in communication with both the outer surface of roll cover 94 and main flow channels defined within tubes 92. Additionally, each of rolls 80, 82 and 84 is formed with a plurality of openings in the form of holes 98 which are coincident with a corresponding secondary flow channel 96. Each hole 98 also extends from and is in communication with the outer surface of roll cover 94 and the main flow channel within a tube 92. These holes 98 provide an increased flow area for drawing water and air into the main flow channels within tubes 92. Various configurations of the holes are possible, such as the configurations and patterns of holes 98 shown in lower portions of FIGS. 4–6.

Figures 4, 5, 6, 7:
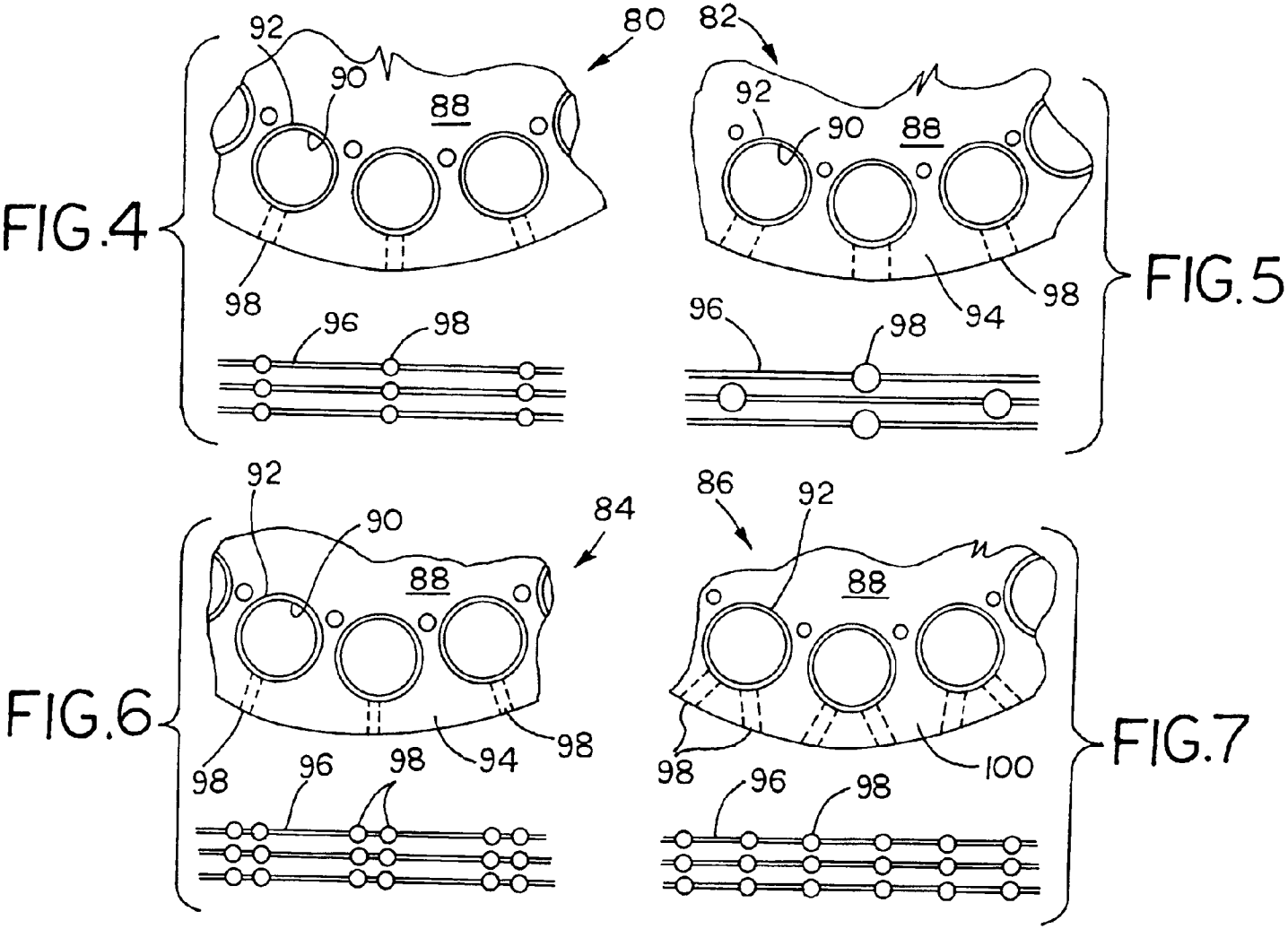
FIG. 4 is a fragmentary, end view illustrating another embodiment of a vented roll according to the present invention.
FIG. 5 is a fragmentary, end view illustrating another embodiment of a vented roll according to the present invention.
FIG. 6 is a fragmentary, end view illustrating another embodiment of a vented roll according to the present invention.
FIG. 7 is a fragmentary, end view illustrating another embodiment of a vented roll according to the present invention.

FIG. 7 illustrates another embodiment of a roll 86 with a roll shell 88 constructed the same as shown in FIGS. 4–6. Roll 86 also includes secondary flow channels 96 with coincident holes 98 for providing an increased flow rate. Holes 98 are drilled at an acute angle relative to a radially inward direction as shown. Roll cover 100 is not formed as a two-layer cover as shown in FIGS. 4–6, but rather is formed as a single layer cover from a single material.

Figure 8:
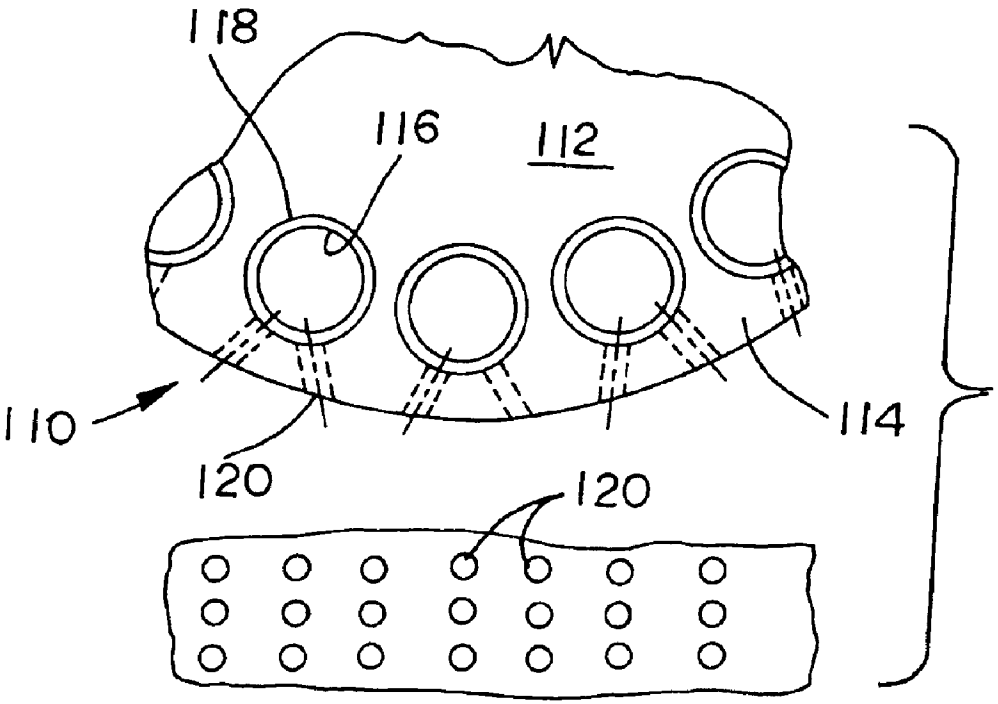
FIG. 8 is a fragmentary, end view illustrating another embodiment of a vented roll according to the present invention.

FIG. 8 illustrates yet another embodiment of a roll 110 of the present invention, which generally includes a roll shell 112 and a roll cover 114. Roll shell 112 is formed with a plurality of grooves 116 in which tubes 118 are respectively positioned, as described above. Roll cover 114 includes a plurality of secondary flow channels in the form of holes 120 which are formed in a uniformly distributed pattern. Each hole 120 extends between and is in communication with an outer surface of roll cover 114 and a main flow channel defined within a corresponding tube 118. Holes 120 are shown as being positioned at an acute angle relative to a radially inward direction, but may also be drilled generally radially inwardly from the outer surface of roll cover 114 to intersect a corresponding main flow channel within a tube 118. Likewise, the size, number and pattern of holes 120 may vary, depending on the application.

Figure 9:
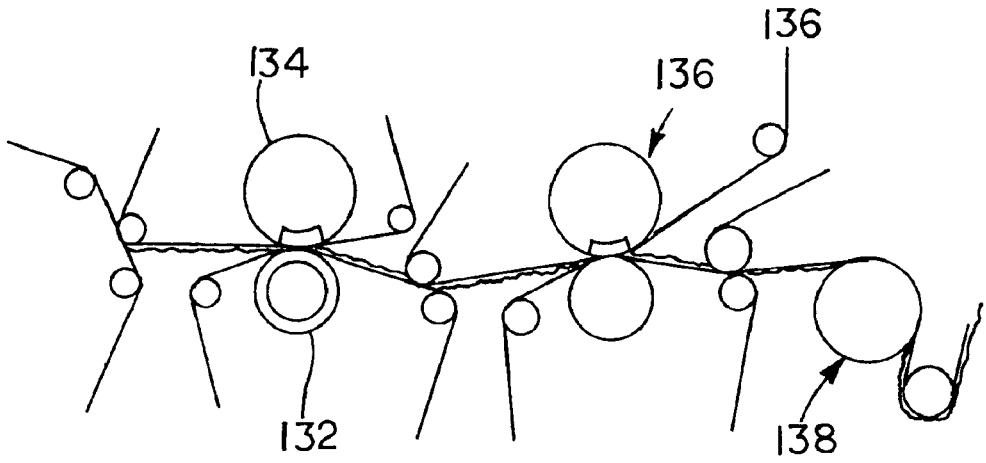
FIG. 9 is a schematic illustration of a paper machine which may utilize a vented roll configured according to the present invention.

FIG. 9 illustrates a portion of an embodiment of a paper machine 130 in which a roll 132 may be configured according to the present invention. Roll 132 may be configured in any suitable manner according to the present invention as described above with regard to the variants shown in FIGS. 1–8. Roll 132 co-acts with a shoe press roll 134 that is part of a shoe nip press. A conventional shoe nip press 136 and drying section 138 are positioned downstream from roll 132 and co-acting shoe press roll 134.

Figure 10:
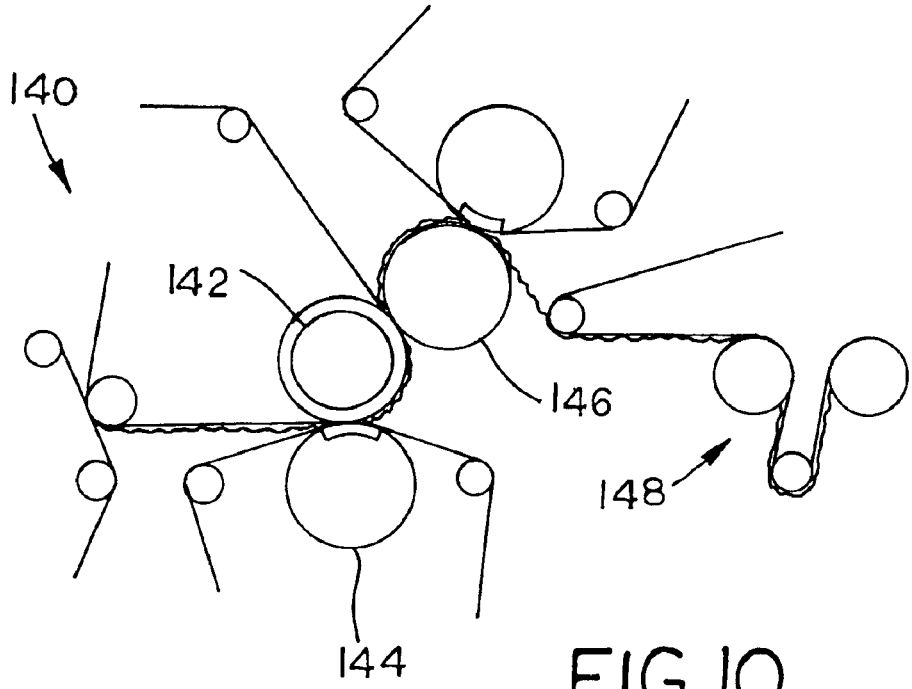
FIG. 10 is a schematic illustration of another embodiment of a paper machine which may utilize a vented roll configured according to the present invention.

FIG. 10 illustrates a portion of another embodiment of a paper machine 140 including a suction press roll 142 which may be configured according to the present invention, such as the examples shown and described with reference to FIGS. 1–8 above. Suction press roll 142 co-acts with a shoe press roll 144 and a solid roll 146 located upstream from a drying section 148.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A roll for use in a paper machine, comprising:

a roll shell having an inner periphery;

a roll cover around said roll shell and having an outer surface, at least one of said roll cover and said roll shell including at least one main flow channel positioned radially inward from said outer surface and radially outward from said inner periphery, said roll cover including at least one secondary flow channel in communication with each of said outer surface and at least one said main flow channel, said at least one main flow channel defined partly in said roll shell and partly in said roll cover.

2. The roll of claim 1, wherein said main flow channel has a cross-sectional area which is larger than a cross sectional area of said at least one secondary flow channel.

3. The roll of claim 1, wherein said roll shell has a longitudinal axis and includes a plurality cylindrical openings extending generally parallel to said longitudinal axis.

4. The roll of claim 1, wherein each said secondary flow channel is slot shaped.

5. The roll of claim 4, wherein each said secondary flow channel is one of ring shaped around said roll cover and helical shaped around said roll cover.

6. The roll of claim 1, wherein said roll shell is comprised of one of steel and stainless steel, and said roll cover is comprised of at least one of plastic, fiberglass, urethane, epoxy, rubber and a polymeric material.

7. The roll of claim 1, further including a press assembly having said roll.

8. The roll of claim 7, wherein said press assembly comprises one of an air press, an extended nip press, a shoe nip press, and a roll nip press.

9. The roll of claim 1, further including one of an air diffusion sleeve and an air diffusion fabric around at least a portion of said roll cover.

10. A roll for use in a paper machine, comprising:

a roll shell having an inner periphery;

a roll cover around said roll shell and having an outer surface, at least one of said roll cover and said roll shell including at least one main flow channel positioned radially inward from said outer surface and radially outward from said inner periphery, said roll cover including at least one secondary flow channel in communication with each of said outer surface and at least one said main flow channel;

wherein said roll shell has a plurality of grooves formed therein, and further including a plurality of tubes respectively positioned in said grooves, each said tube defining a respective said main flow channel.

11. The roll of claim 10, wherein said roll shell has a longitudinal axis, and said grooves extend generally parallel to said longitudinal axis.

12. The roll of claim 11, wherein said roll cover is in continuous and intimate physical contact with said plurality of tubes and said roll shell.

13. A roll for use in a paper machine, comprising:

a roll shell having an inner periphery;

a roll cover around said roll shell and having an outer surface, at least one of said roll cover and said roll shell including at least one main flow channel positioned radially inward from said outer surface and radially outward from said inner periphery, said roll cover including at least one secondary flow channel in communication with each of said outer surface and at least one said main flow channel; and at least one opening coincident with a corresponding said secondary flow channel.

14. The roll of claim 13, wherein each said opening is a generally cylindrical hole having a diameter which is wider than a width of said corresponding secondary flow channel.

15. A roll for use in a paper machine, comprising:

a roll shell having an inner periphery;

a roll cover around said roll shell and having an outer surface, at least one of said roll cover and said roll shell including at least one main flow channel positioned radially inward from said outer surface and radially outward from said inner periphery, said roll cover including at least one secondary flow channel in communication with each of said outer surface and at least one said main flow channel; and a plurality of tubes, each said tube defining a respective said main flow channel.

16. The roll of claim 15, wherein each said tube is comprised of one of epoxy, fiberglass, carbon fiber, rubber and stainless steel.

17. A method of manufacturing a roll for use in a paper machine, comprising the steps of:

providing a roll shell;

covering said roll shell with a roll cover;

forming at least one main flow channel radially inward from an outer surface of said roll cover and radially outward from an inner periphery of said roll shell, including forming the main flow channel partly in the roll shell and partly in the roll cover; and machining at least one secondary flow channel in said roll cover which is in communication with each of said outer surface and at least one said main flow channel.

18. The method of manufacture of claim 17, wherein said machining step comprises machining a slot in said roll cover which extends into said main flow channel.

19. The method of manufacture of claim 17, wherein said roll shell has a longitudinal axis, and said forming step includes drilling a plurality cylindrical openings extending generally parallel to said longitudinal axis.

20. The method of manufacture of claim 17, further including the step of placing an air diffusion member around at least a portion of said roll cover.

21. The method of manufacture of claim 20, wherein said air diffusion member comprises one of an air diffusion sleeve and an air diffusion fabric.

22. The method of manufacture of claim 17, further including the step of surface finishing said roll cover.

23. The method of manufacture of claim 22, wherein said surface finishing step includes at least one of grinding and coating.

24. A method of manufacturing a roll for use in a paper machine, comprising the steps of:

providing a roll shell;

covering said roll shell with a roll cover;

forming at least one main flow channel radially inward from an outer surface of said roll cover and radially outward from an inner periphery of said roll shell; and machining at least one secondary flow channel in said roll cover which is in communication with each of said outer surface and at least one said main flow channel; and wherein said forming step includes placing a plurality of tubes adjacent an outer periphery of said roll shell.

25. The method of manufacture of claim 24, wherein said forming step further includes forming a plurality of grooves in said roll shell, each of said plurality of tubes being placed in a corresponding groove in said roll shell.

26. A method of operating a roll in a paper machine, comprising the steps of:

providing a roll shell having opposite ends and an inner periphery;

providing a roll cover around said roll shell, said roll cover having an outer surface;

providing at least one main flow channel radially inward from said outer surface and radially outward from said inner periphery, each said main flow channel having opposite ends terminating at said respective roll shell ends and being partly in said roll shell and partly in said roll cover;

providing at least one secondary flow channel in said roll cover, each said secondary flow channel being in communication with each of said outer surface and at least one said main flow channel; and at least intermittently sealing said ends of said main flow channels during rotation of said roll.

27. The method of operation of claim 26, including the step of applying one of a positive pressure or vacuum pressure to one or both ends of said main flow channels.

28. The method of operation of claim 26, wherein said main flow channels have one of a substantially constant and varying inside diameter along a length thereof.

29. The method of operation of claim 26, wherein each said secondary flow channel has one of a substantially constant and varying contact area with said at least one main flow channel.

30. A method of operating a roll in a paper machine, comprising the steps of:

providing a roll shell having opposite ends and an inner periphery;

providing a roll cover around said roll shell, said roll cover having an outer surface;

providing at least one main flow channel radially inward from said outer surface and radially outward from said inner periphery, each said main flow channel having opposite ends terminating at said respective roll shell ends;

providing at least one secondary flow channel in said roll cover, each said secondary flow channel being in communication with each of said outer surface and at least one said main flow channel;

at least intermittently sealing said ends of said main flow channels during rotation of said roll; and wherein said at least one main flow channel comprises a plurality of main flow channels, and sealing step comprises sealing a subset of said plurality of main flow channels during said rotation of said roll.

31. The method of operation of claim 30, wherein said plurality of main flow channels comprise one of a plurality of tubes and a plurality of cylindrical openings.

* * * * *

UNITED STATES PATENT AND TRADEMARK OFFICE

CERTIFICATE OF CORRECTION

PATENT NO. : 6,884,323 B2
DATED : April 26, 2005
INVENTOR(S) : Beck et al.

It is certified that error appears in the above-identified patent and that said Letters Patent is hereby corrected as shown below:

Column 4,
Line 11, delete “34”, and substitute -- 3/4 --; and
Line 33, prior to “as”, insert -- ( --.

Signed and Sealed this

Seventeenth Day of January, 2006

JON W. DUDAS
*Director of the United States Patent and Trademark Office*